US005816418A

United States Patent [19]

Hsu

[11] Patent Number: 5,816,418

[45] Date of Patent: Oct. 6, 1998

[54] STORAGE RACK WITH EXTENSION DEVICE

[76] Inventor: Jung-Hsiang Hsu, 177 Morningside Rd., Paramus, N.J. 07652

[21] Appl. No.: 960,662

[22] Filed: Oct. 30, 1997

Related U.S. Application Data

[63] Continuation-in-part of Ser. No. 782,976, Jan. 14, 1997, abandoned.

[51] Int. Cl.[6] ..... A47H 13/00

[52] U.S. Cl. ..... 211/120; 211/11; 211/184

[58] Field of Search ..... 211/120, 184, 211/11, 42, 43

[56] References Cited

U.S. PATENT DOCUMENTS

| | | | |
|---|---|---|---|
| 2,619,233 | 11/1952 | Weiskopf | 211/120 |
| 3,094,129 | 6/1963 | Wills | 211/120 |
| 3,176,849 | 4/1965 | Peebles | 211/11 |
| 5,307,941 | 5/1994 | Siegal | 211/120 |

*Primary Examiner*—Peter M. Cuomo
*Assistant Examiner*—Anthony D. Barfield
*Attorney, Agent, or Firm*—Watov & Kipnes, P.C.

[57] ABSTRACT

A self-adjusting storage rack including a plurality of coaxial coils wherein at least one pair of adjacent coils are provided with an extender to extend the storage area for flexible documents such as magazines so that they may stand in an upright position, the extender having a lower section which provides forcible contact with the coils to provide support for the extender in the upright position.

3 Claims, 7 Drawing Sheets

STORAGE RACK WITH EXTENSION DEVICE

RELATED APPLICATION

This is a Continuation-In-Part Application of U.S. Ser. No. 08/782,976 filed Jan. 14, 1997 now abandoned.

FIELD OF THE INVENTION

The present invention relates to a self-adjusting storage rack, especially a self-adjusting storage rack for holding stationery, envelopes, letters, file folders, cards, photos, magazines, and similar flat articles in an upright position for ready use. The invention is particularly directed to a storage rack having extenders for storing large non-rigid documents (e.g. magazines) in an upright position which are especially suited for self-adjusting storage racks.

BACKGROUND OF THE INVENTION

The Applicant herein is the owner of U.S. Pat. No. 5,421,466 which is directed to a self-adjusting storage rack. The above-mentioned patent includes a continuous resilient spiral element having first and second ends and a plurality of coaxial windings therebetween. Each pair of adjacent coaxial windings defines an upright storage space for printed documents and the like. In the construction shown in the '466 patent, the spiral windings effectively support letter size documents and taller documents that have a rigid construction. The spiral windings are movable laterally so that storage areas between adjacent windings can expand as the quantity of documents stored therein increases.

Taller documents such as magazines, which do not have a rigid construction, are difficult to store in an upright position because the storage area defined by the movable coaxial windings is of insufficient height to provide the desired support.

One solution to this problem is to increase the diameter of the coaxial windings so that the same extend over a greater portion of the height of the document. However, increasing the diameter of the coaxial windings increases the cost of the storage rack to a significant extent and therefore is not practical.

It is known in the art to provide a partition on a non-self adjusting storage rack. In particular, D.M. Peebles (U.S. Pat. No. 3,176,849) discloses a storage rack having stationery loops 21 for forming storage areas or compartments. There is optionally provided bottom-opening envelope-like index partitions 54 made of paper or plastic which may be removably telescoped over any or all of the upstanding stationery loops 21. The partitions are intended to more clearly differentiate the storage areas and may optionally be provided with index tabs.

Such partitions operate well when the loops are stationery (i.e. each storage area has a fixed area defined in part by a fixed distance between each loop). However, when the loops are movable laterally as in self-adjusting storage racks, tension is applied to the individual loops during such movement. The partitions described in U.S. Pat. No. 3,176,849 are not designed to accommodate laterally movable loops and can therefore be damaged by the loops (e.g. when the partitions are constructed of paper) or prevent movement of the loops when the partitions are constructed of a rigid material.

It would therefore be a significant advance in the art of storage racks, especially self-adjusting storage racks of the type shown and described in U.S. Pat. No. 5,421,466 if at least some of the coaxial windings could be extended to accommodate tall, non-rigid documents so that they may be stored in an upright position.

It would be a further significant advance in the art of producing self-adjusting storage racks to provide extenders which are adapted to function with spiral windings and the like as they move laterally.

SUMMARY OF THE INVENTION

The present invention is directed to a storage rack, particularly self-adjusting storage racks of the type shown in U.S. Pat. No. 5,421,466, (incorporated herein by reference) in which the coaxial windings can be extended by the attachment thereto of a removable extender. The removable extender is flexible so that it upon lateral movement of the coaxial winding the extender is firmly secured about the winding to provide rigid support for the articles placed in the storage area.

In particular, the present invention is directed to a self-adjusting storage rack for the storage of at least one article comprising:

(a) a continuous resilient spiral element having first and second ends affixed to respective first and second support portions, a plurality of movable coaxial windings between the first and second ends, the plurality of movable coaxial windings defining an interior axial region and having respective upper ends, said storage regions being expandable or contractible upon movement of the coaxial windings, wherein axially adjacent pairs of coaxial windings communicate with the article;

(b) first and second support portions attached to the respective ends of the spiral element for providing support for the spiral element so that the movable coaxial windings are maintained in an upright position for storing at least one article; and (c) removable extension means attachable to the upper end of at least one of the coaxial windings to thereby increase the height of the coaxial winding, said removable extension means comprising a housing having a rigid upper section for providing support to an article placed within a storage region and a lower section for receiving a coaxial winding, said lower section having walls having a bottom end and sides, the walls along the bottom end being spaced apart to define an opening for receiving the coaxial winding, the sides of the walls being spaced apart to enable the extension means be rigidly secured to the coaxial winding when the coaxial winding moves laterally.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

Figure 1:
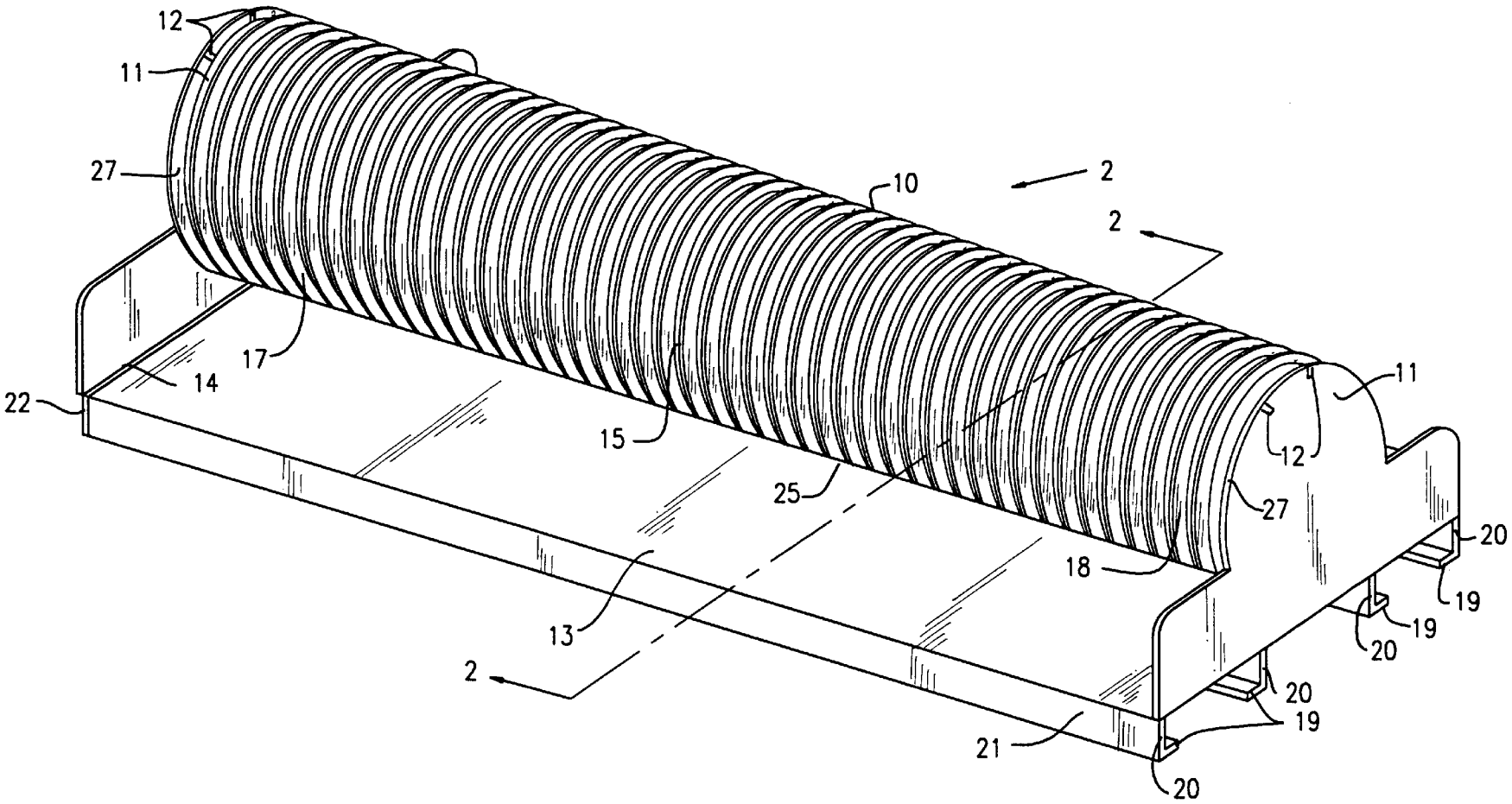
FIG. 1 is a perspective view of a self-adjusting storage rack of the prior art which can be improved in accordance with the present invention.
Figure 2:
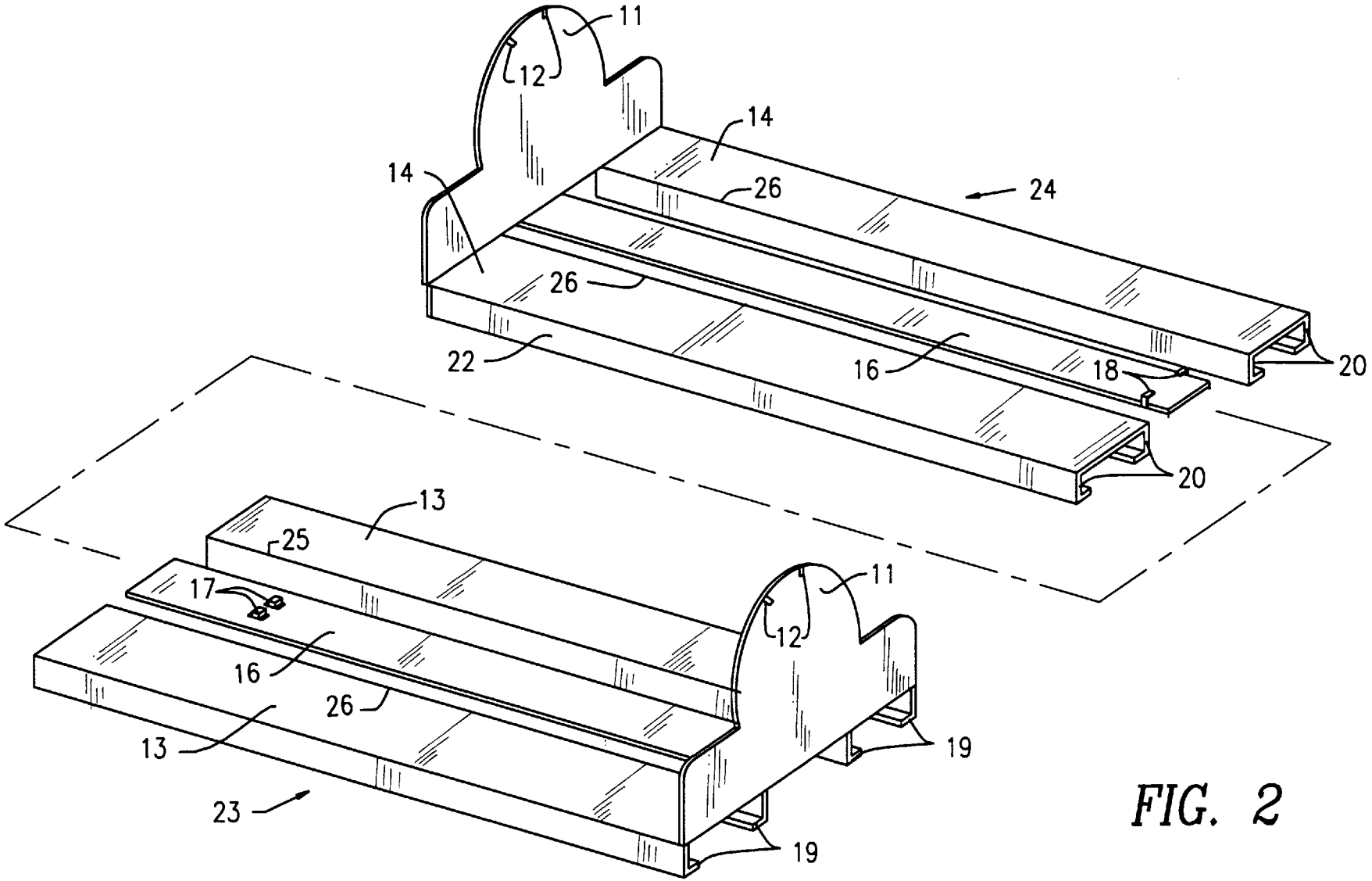
FIG. 2 is a perspective view of the prior art storage rack shown in FIG. 1 showing the support frame of the storage rack.

Referring to FIG. 1 and FIG. 2 there is shown a storage rack 2 including an elastic coil or winding 10 with left and right male and female support sections 11, 13, and 15 with the entire female section being identified by numeral 23. The male section of the storage rack assembly 2 is identified by numerals 11, 14, and 16 with the entire male section being designated by numeral 24. The female section 23 comprises a vertical end-plate 11, two outer flat tubular rods 13 and one inner top sliding flat solid rod 15. The male section 24 comprises a vertical end-plate 11, and two outer flat tubular rods 14 that can be inserted into the tubular rods 13 in a telescopic manner. An inner bottom sliding flat solid rod 16 slides beneath a top sliding rod 15 in a telescopic manner as well. The rod 16 is connected to the rod 15 by side flanges 18. Each section has a vertical plate 11 at a 90 degree angle to the telescopic rods which include the sliding rod 15 and two flat outer tubular rods 13 for the female section and one flat solid rod 16 and two flat tubular rods 14 for the male section.

The coil 10 between the end-plates 11 has end coils 27 attached to the inner side plate by punched out tabs 12. When the section 24 is inserted into the section 23 and the elastic coils 10 are attached to the end plates 11, the elastic self-adjusting supports adjust themselves when the storage rack is manually expanded and shortened.

The inner telescopic rods 15 and 16 run through the lower part of the coil 10 just above the bottom coils, keeping the extended coil in the center and preventing the coil from moving upward. The lower part of the coil is held between the inner rims 25 and 26 when the telescopic rods 13 and 14 are manually extended. The telescopic rods 13 and 14 as well as the telescopic rods 15 and 16 have flat coplanar tops. The base female telescopic rods 13 have inner rails 19 which accept the inner male rails 20. The right angle sides of the female flat telescopic rods 21 extend downward at a 90 degree angle and are of sufficient width so as to prevent the lower part of the coil from touching the surface of the platform on which the coils are placed so the coils can slide freely back and forth.

The storage rack assembly 2 is compact and suitable for placing on desktops or any convenient flat surface. The telescopic rods even when extended will hold their position since the elastic coils 10 exert negligible tension between the end-plates 11. Punched-out tabs stops 17 on center rod 15 will engage flanges 18 on center rod 16 to prevent sections from being pulled apart completely. The base of the rack may be tilted at a suitable angle by having the front perpendicular sides 21 and 22 wider than the corresponding back perpendicular sides. Further details of the self-adjusting storage rack in accordance with the prior art are disclosed in U.S. Pat. No. 5,421,466, incorporated herein by reference.

Figure 3:
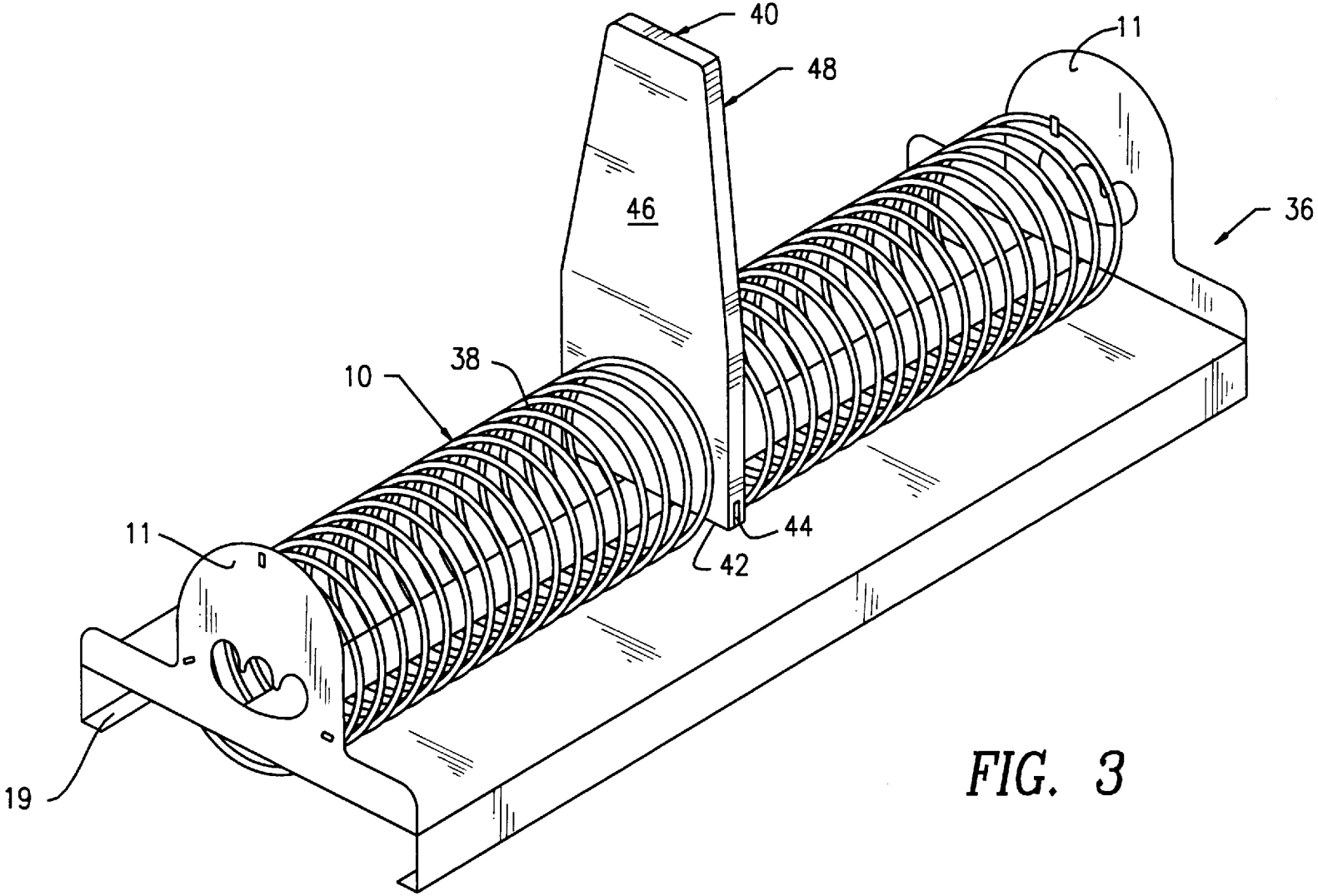
FIG. 3 is a perspective view of a storage rack in accordance with the present invention showing an embodiment of an extender placed over a coaxial winding.
Figure 4:
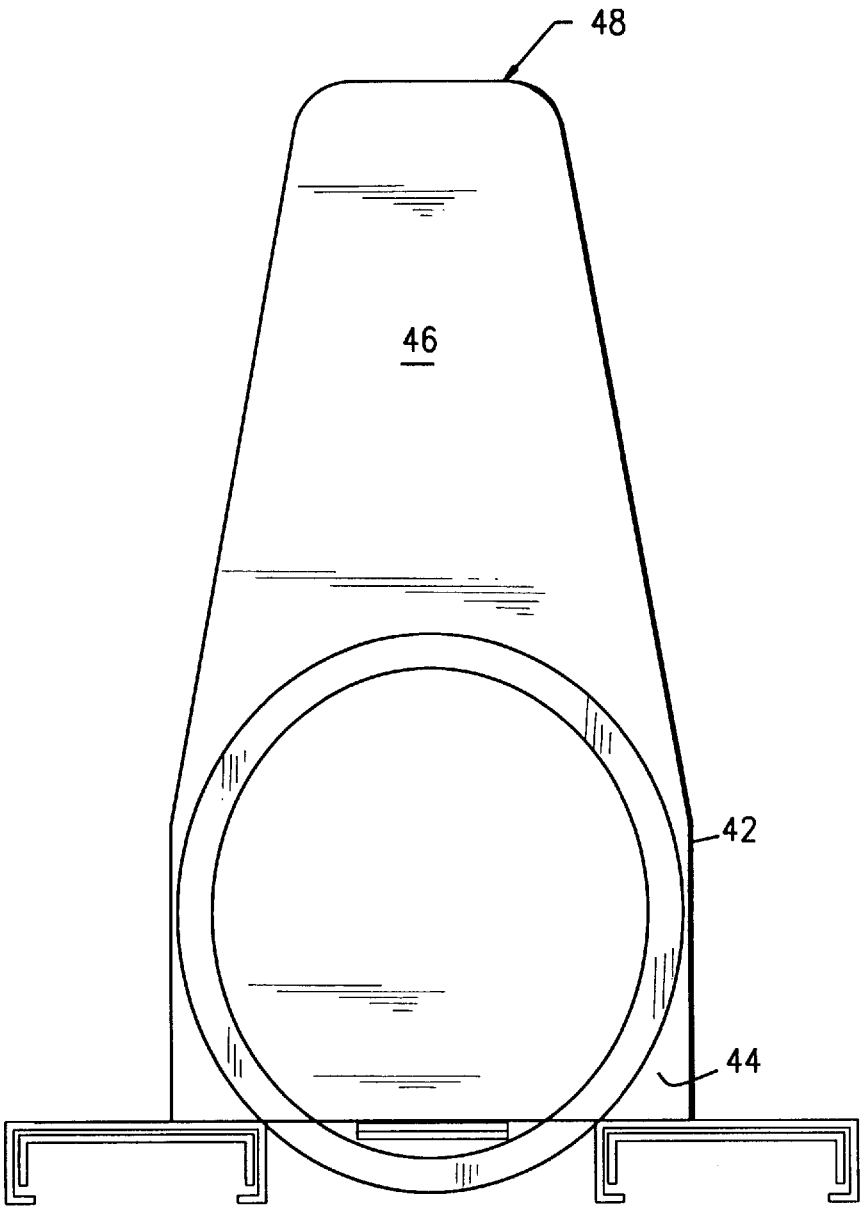
FIG. 4 is a cross-sectional view of the extender shown in FIG. 3 showing a channel for receiving a coaxial winding therein.

In accordance with the present invention, there is provided an extender suitable for attaching to the coaxial windings of storage racks such as disclosed, for example, in U.S. Pat. No. 5,421,466. As shown in FIGS. 3 and 4, a self-adjusting storage rack assembly 36 is provided with opposed plates 11 providing adjustable support for elastic coil 10 wherein adjacent elastic coils 10 define a document storage area 38.

In accordance with the present invention, there is provided an extender 40 having a base 42 having therein a channel 44 which is adapted to extend over and receive at least a portion of an elastic coil 10. Insertion of the elastic coil 10 into the channel 44 supports the extender 40 in the upright position so that relatively tall, non-rigid articles such as magazines may lean against the extender and remain in an upright position.

Details of the extender 40 are shown in FIG. 4. The extender 40 comprises front and rear sides 46 and 48 with the channel 44 appearing therebetween at the base 42.

The extenders can be made from a variety of materials including metal, wood, plastic, corrugated paper products and the like. Rigid plastic materials like polypropylene and the like are suitable because they are relatively inexpensive.

As previously indicated, a document is stored in the document storing region 38 between two adjacent coils 10. If extenders 40 are placed on adjacent coils 10, is the document storage area is extended to the extent the adjacent extenders extend above the coils.

Figure 5:
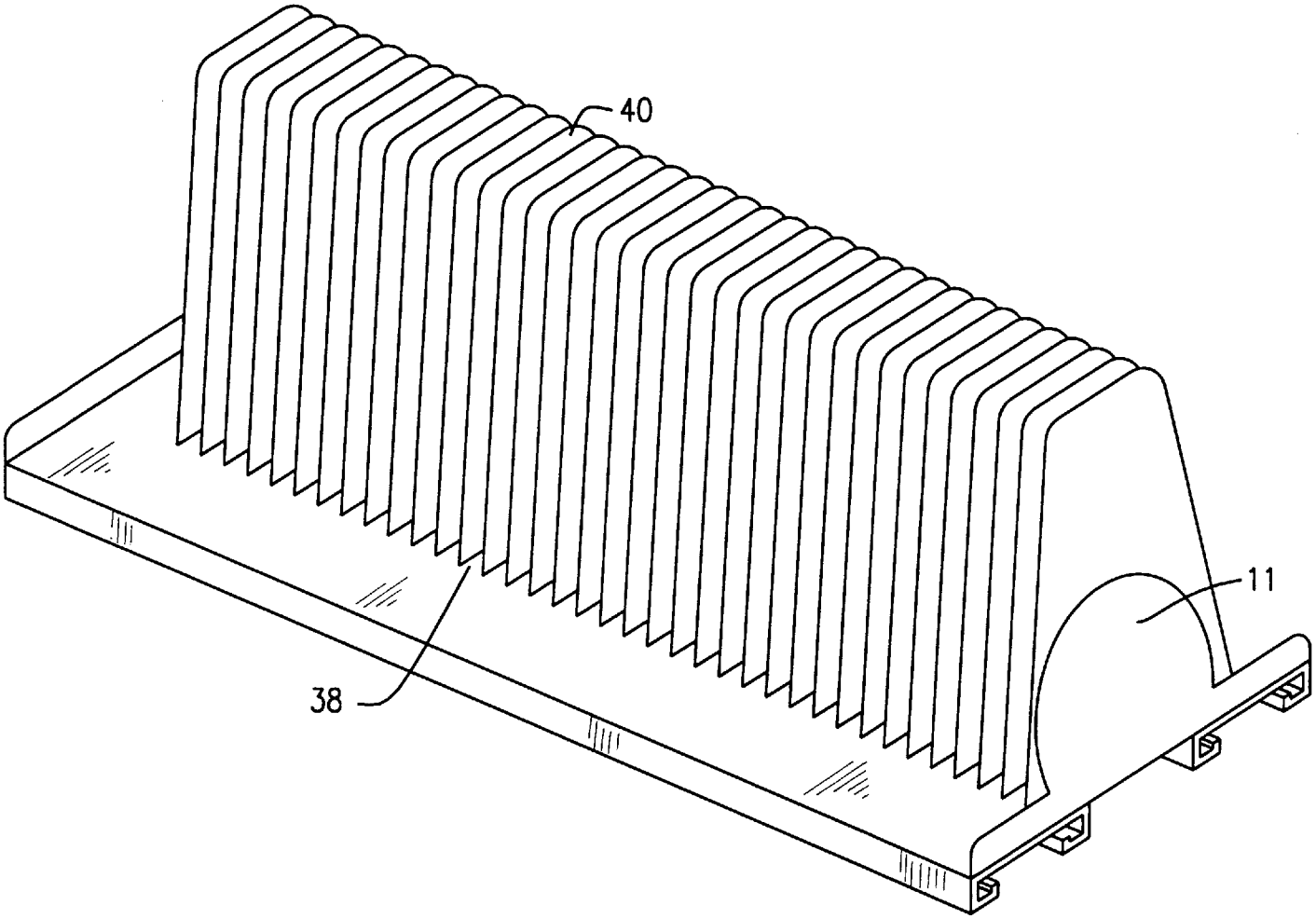
FIG. 5 is a perspective view of a self-adjusting storage rack with a plurality of extenders placed over the coaxial windings.

Referring to FIG. 5, there is shown a storage rack assembly having each of the coils 10 mounted by an extender 40 therefore defining a plurality of enlarged storage areas 38. It will be appreciated that the storage rack assembly need not employ extenders over all of the coils but as few as two with each pair of adjacent extenders 40 defining a single enlarged storage area 38.

It will be further appreciated that the present invention can be employed on any storage rack assembly employing a plurality of coils. The storage rack assembly need not be adjustable or extendable although these characteristics of the storage rack assembly as disclosed in U.S. Pat. No. 5,421,466 are preferred. It is also within the purview of the present invention to have the extenders attached to the coils by other means.

In a preferred form of the invention the extender is adapted to adjust with the lateral movement of the coaxial windings to provide enhanced support for the extender.

Figure 6:
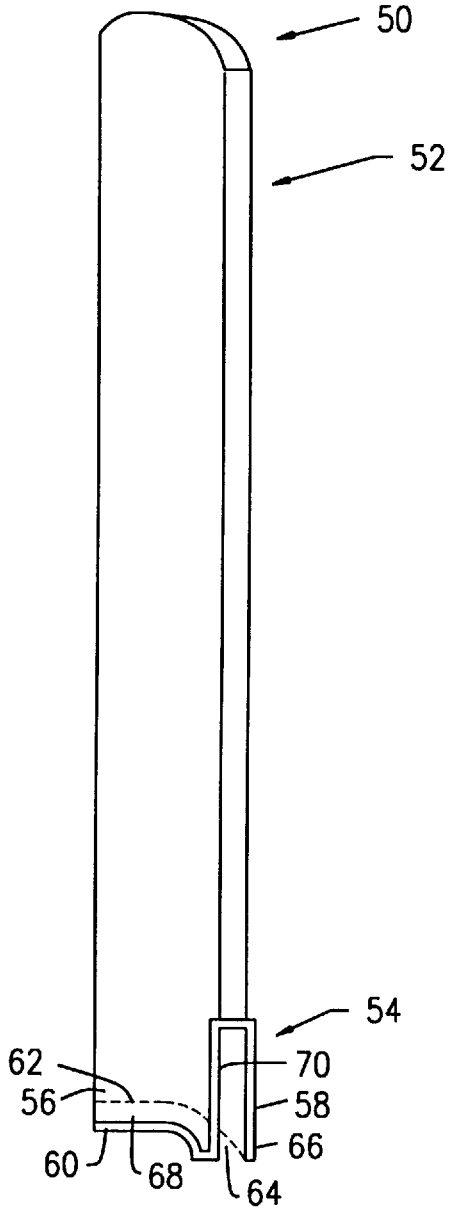
FIG. 6 is a perspective view of an extender with side openings to enable the extender to securely engage the coaxial windings.

Referring to FIG. 6, there is shown a preferred extender 50 having an upper section 52 and a lower section 54. The upper section 52 is preferably made of a solid material such as plastic which provides support for documents and the like positioned in storage areas defined by coaxial windings as shown in FIG. 5.

The lower section 54 is adapted to be placed over the coaxial winding. In accordance with this preferred embodiment, the lower section is comprised of spaced apart walls 56, 58 having respective bottom ends 60, 62 and sides 64, 66. The bottom ends 60, 62 define an opening 68 for receiving a coaxial winding. The sides 64 and 66 of the walls 56, 58 define an opening 70 as discussed hereinafter.

Figure 7:
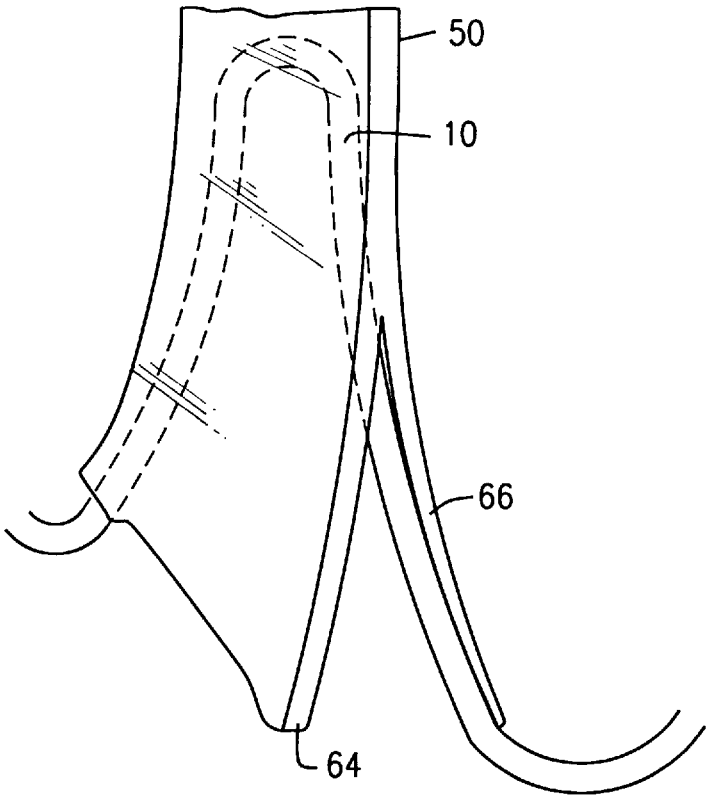
FIG. 7 is a partial perspective view of the extender shown in FIG. 6 when the coaxial winding has undergone lateral movement.
Figure 1:
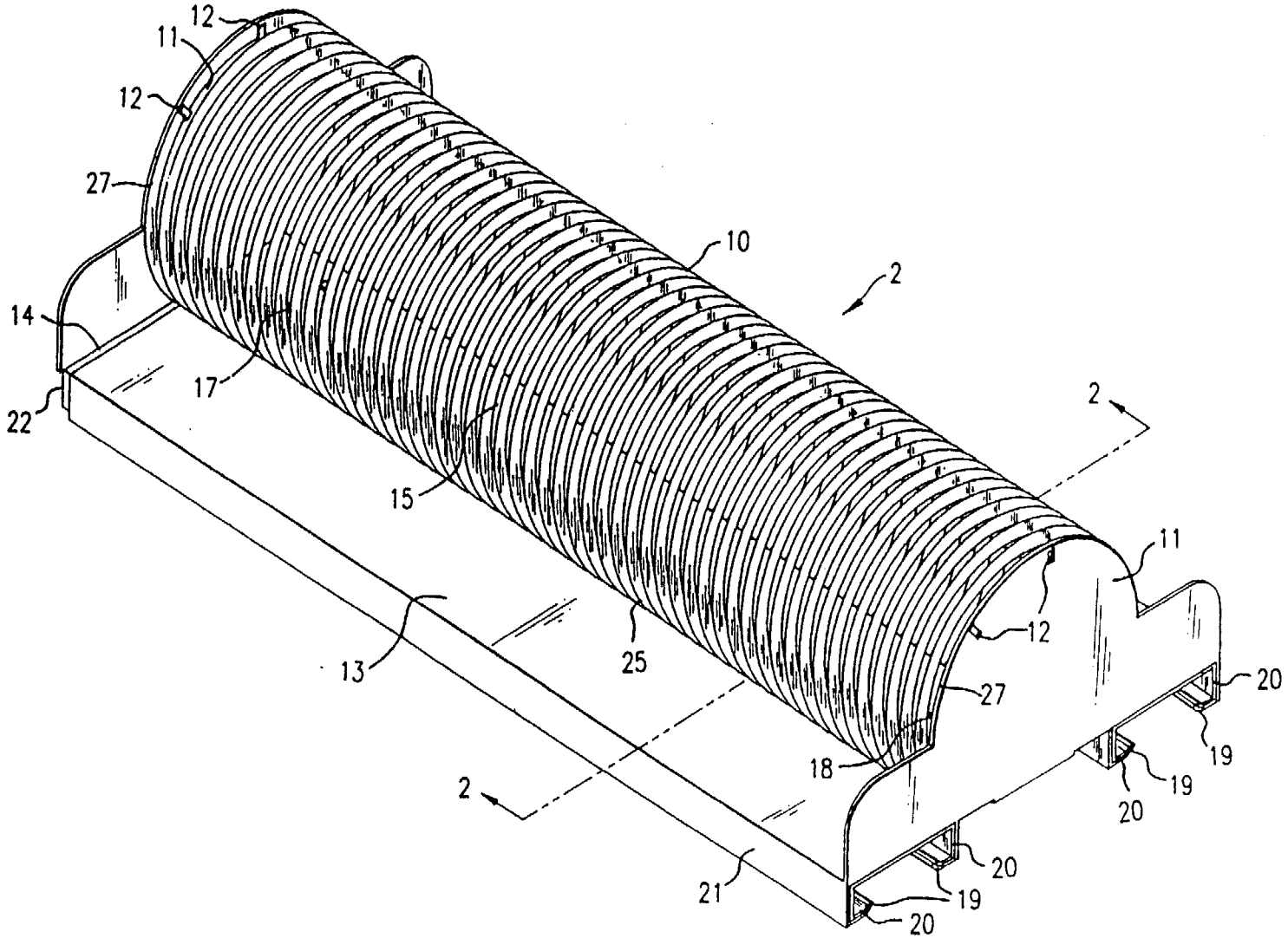
Figure 2:
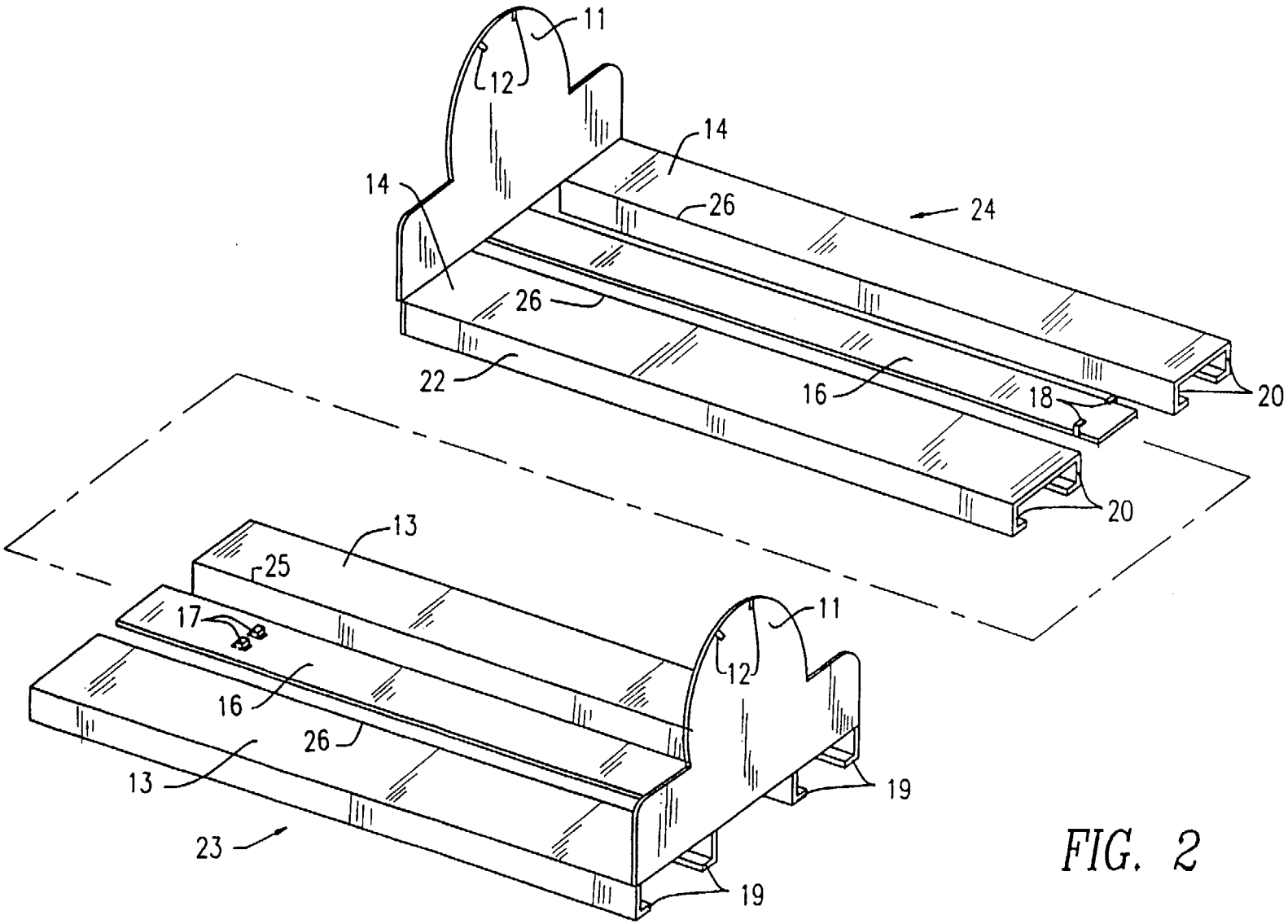
Figure 3:
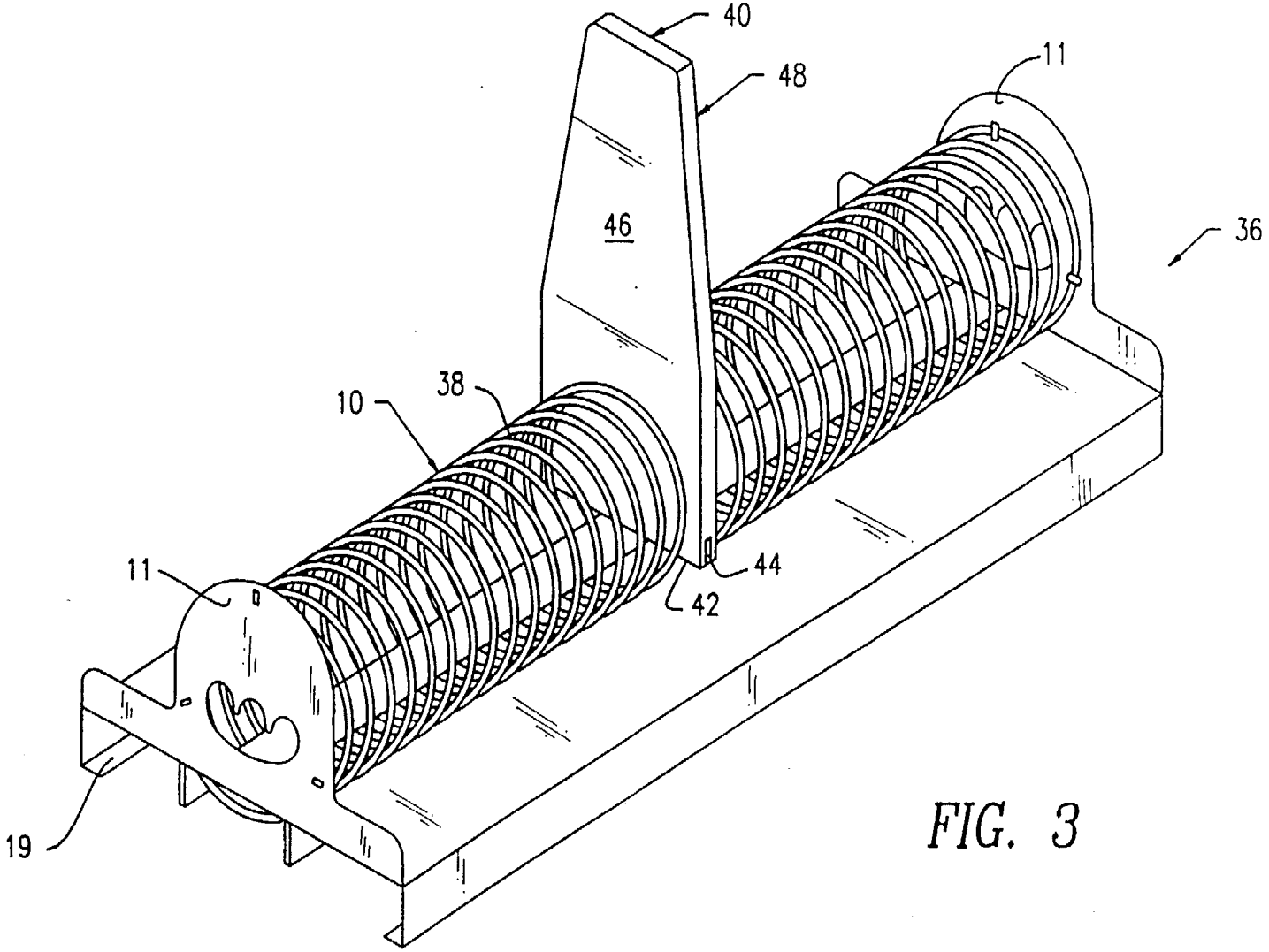
Figure 4:
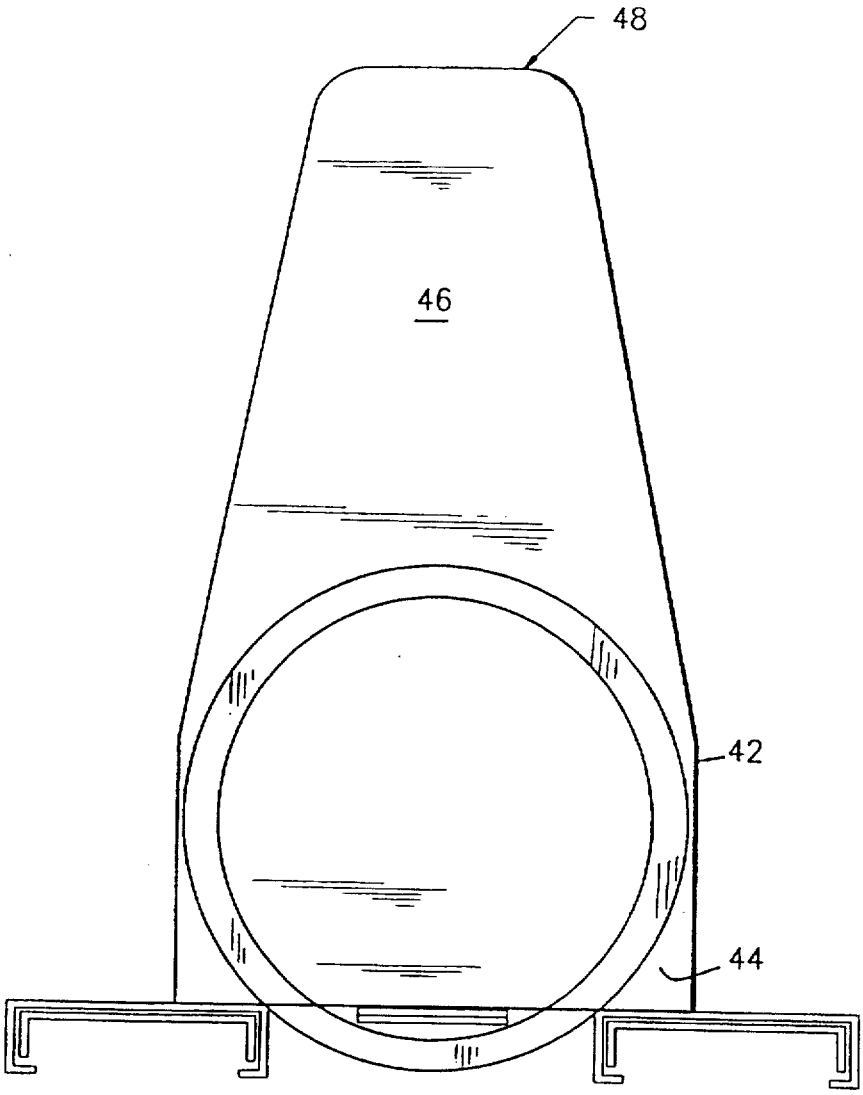
Figure 5:
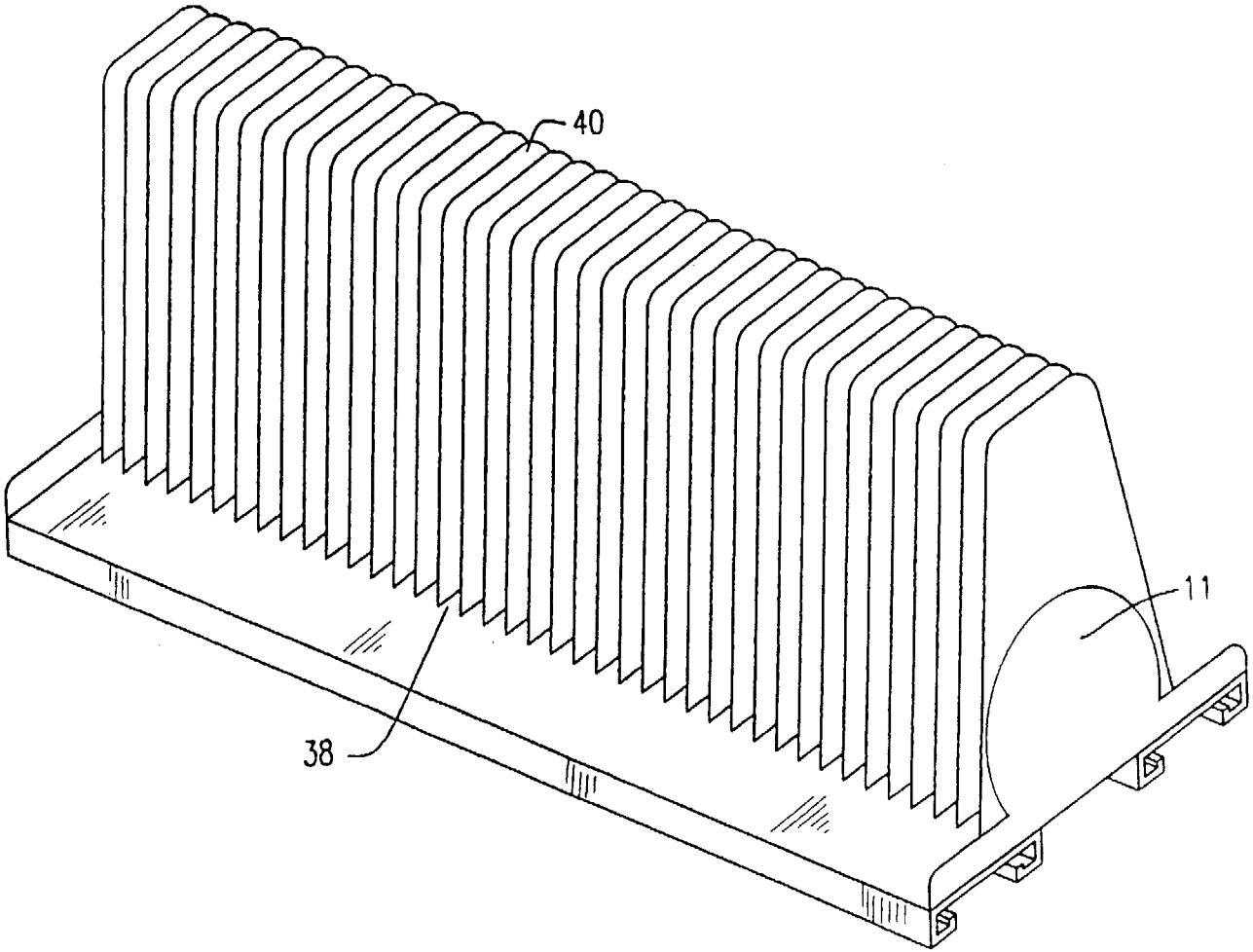
Figure 6:
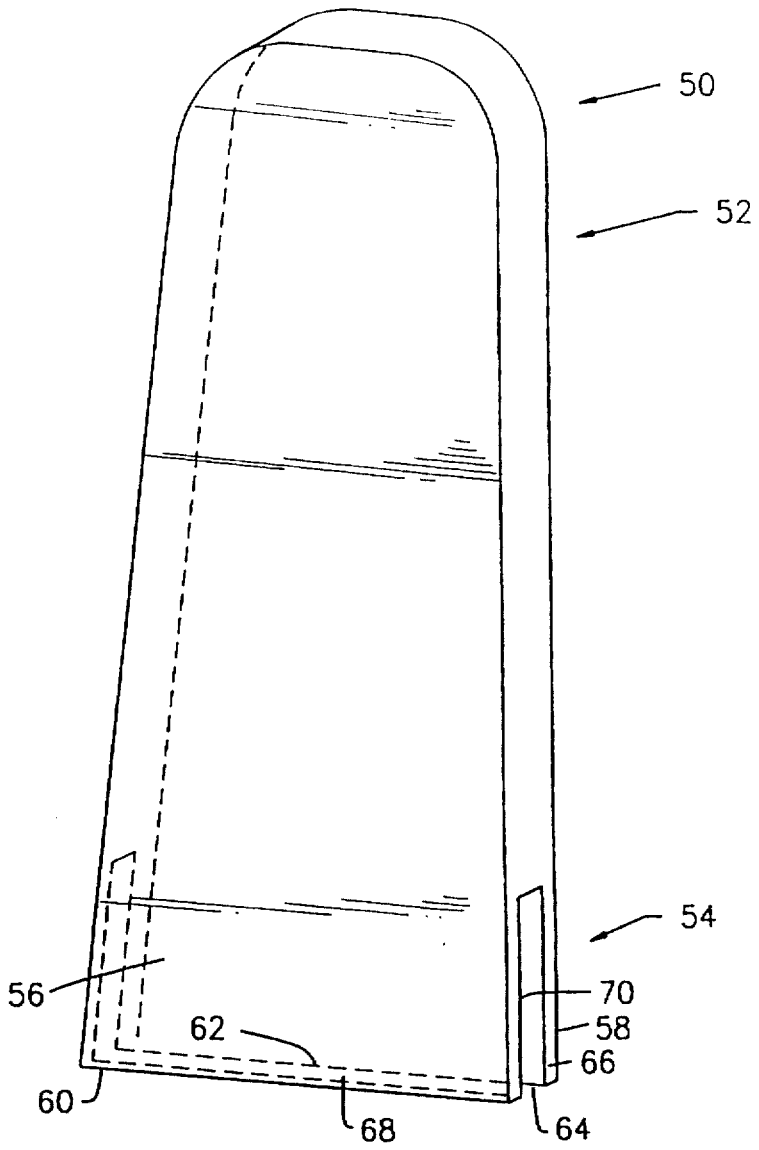
Figure 7:
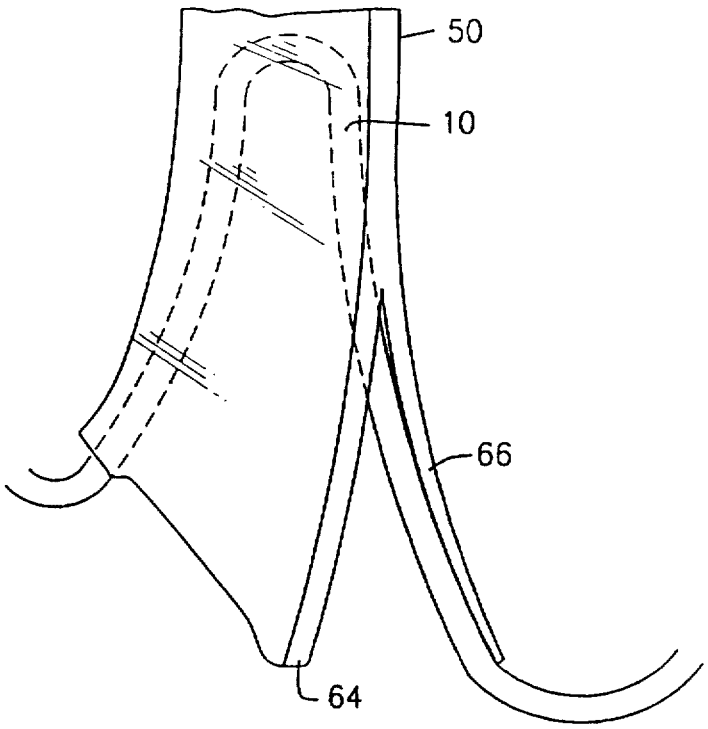

The sides 64 and 66 are sufficiently flexible so that when a force is exerted on the coaxial winding, the side 64 or the side 66 pushes against the coaxial winding to provide a force which secures the extender 50 thereon as shown in FIG. 7.

Referring to FIG. 7, when the coaxial winding is stretched because a significant load of documents is placed in one or more of the storage areas, the lower section of the extender is caused to stretch as well as described hereinafter.

As the coaxial winding or coil 10 is stretched laterally by documents contained within one or both adjacent storage areas, the coil contacts and spreads the sides 64 and 66 of the extender 50. The sides 64 and 66 shown specifically in FIG. 7 thereby exert an opposed force against the coil 10. As a result, the extender 50 is drawn tightly against the coil 10 to provide a device which is particularly adapted to support documents contained within adjacent storage areas in their upright position.

What is claimed is:

1. A self-adjusting storage rack for at least one article comprising:

a) a continuous resilient spiral element having first and second ends affixed to respective first and second support sections, a plurality of movable coaxial windings between the first and second ends, the plurality of movable coaxial windings defining an interior axial storage region and having respective upper ends, said storage regions being expandable or contractible upon movement of the coaxial windings wherein axially adjacent coaxial windings communicate with the article;

b) first and second support portions attached to the respective ends of the spiral element and providing support for the spiral element so that the coaxial windings are maintained in an upright position for storing at least one article; and c) removable extension means attachable to the upper end of the at least one of the coaxial windings to thereby increase the length of the coaxial winding and extend the storage area between adjacent coaxial windings, said removable extension means comprising a housing having an upper section for providing support to an article placed within a storage region and a lower section for receiving the coaxial winding, said lower section having walls having a bottom end and sides, the walls along the bottom end being spaced apart to define an opening for receiving the coaxial winding, the sides of the walls being spaced apart to enable the extension means to be rigidly secured to the coaxial winding when the coaxial winding moves laterally.

2. The storage rack of claim 1 wherein the removable extension means is made of a flexible material selected from the group consisting of metal, wood, plastic, and corrugated paper products.

3. The storage rack of claim 1 wherein the first and second supports are in telescopic relationship.

* * * * *

UNITED STATES PATENT AND TRADEMARK OFFICE

CERTIFICATE OF CORRECTION

PATENT NO. : 5,816,418

DATED : October 6, 1998

INVENTOR(S) : Jung-Hsiang Hsu

It is certified that error appears in the above-identified patent and that said Letters Patent is hereby corrected as shown below:

The title page should be deleted to appear as per attached title page.

The sheets of drawings consisting of figures 1-7, should be deleted to appear as per attached figures 1-7.

Signed and Sealed this

Thirtieth Day of November, 1999

*Attest:*

*Attesting Officer*

Q. TODD DICKINSON

*Acting Commissioner of Patents and Trademarks*

US005816418A

United States Patent [19]

Hsu

[11] Patent Number: 5,816,418

[45] Date of Patent: Oct. 6, 1998

[54] STORAGE RACK WITH EXTENSION DEVICE

[76] Inventor: Jung-Hsiang Hsu, 177 Morningside Rd., Paramus, N.J. 07652

[21] Appl. No. 960,662

[22] Filed: Oct. 30, 1997

Related U.S. Application Data

[63] Continuation-in-part of Ser. No. 782,976, Jan. 14, 1997, abandoned

[51] Int. Cl.[6] ..... A47H 13/00

[52] U.S. Cl. ..... 211/120; 211/11; 211/184

[58] Field of Search ..... 211/120, 184, 211/11, 42, 43

[56] References Cited

U.S. PATENT DOCUMENTS

| | | | |
|---|---|---|---|
| 2,619,233 | 11/1952 | Weiskopf | 211/120 |
| 3,094,129 | 6/1963 | Wills | 211/120 |
| 3,176,849 | 4/1965 | Peebles | 211/11 |
| 5,307,941 | 5/1994 | Siegal | 211/120 |

*Primary Examiner*—Peter M. Cuomo
*Assistant Examiner*—Anthony D. Barfield
*Attorney, Agent, or Firm*—Watov & Kipnes, P.C.

[57] ABSTRACT

A self-adjusting storage rack including a plurality of coaxial coils wherein at least one pair of adjacent coils are provided with an extender to extend the storage area for flexible documents such as magazines so that they may stand in an upright position, the extender having a lower section which provides forcible contact with the coils to provide support for the extender in the upright position.

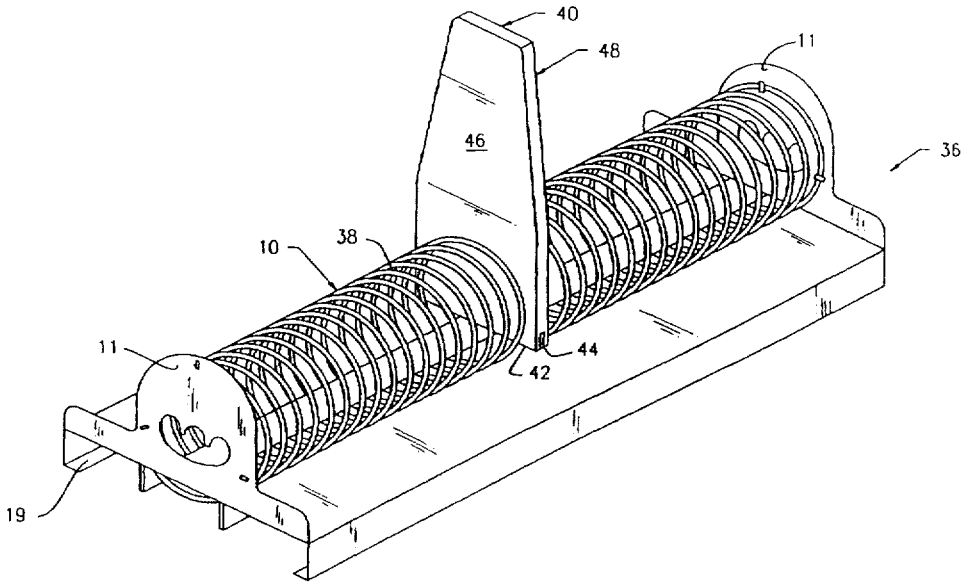

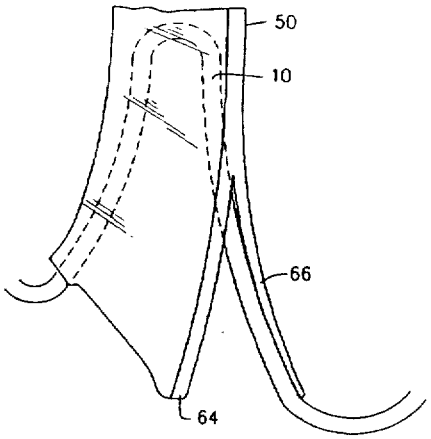

3 Claims, 7 Drawing Sheets